US005920259A

United States Patent [19]

Shpater

[11] Patent Number: 5,920,259

[45] Date of Patent: Jul. 6, 1999

[54] MOTION DETECTION WITH RFI/EMI PROTECTION

[75] Inventor: Pinhas Shpater, Ville St. Laurent, Canada

[73] Assignees: Shmuel Hershkovitz, Canada; Pinhas Shpater, Israel

[21] Appl. No.: 08/967,040

[22] Filed: Nov. 10, 1997

[51] Int. Cl.[6] ..... G08B 13/00

[52] U.S. Cl. ..... 340/565; 340/508; 340/511; 340/567

[58] Field of Search ..... 340/567, 565, 340/552–557, 522, 511, 541, 508; 367/93–94; 342/27–28; 250/DIG. 1

[56] References Cited

U.S. PATENT DOCUMENTS

| | | | |
|---|---|---|---|
| 4,562,723 | 1/1986 | Hubner | 340/633 X |
| 4,975,684 | 12/1990 | Guttinger et al. | 340/522 X |
| 5,194,848 | 3/1993 | Kerr | 340/522 X |
| 5,453,733 | 9/1995 | Peterson et al. | 340/567 |
| 5,473,332 | 12/1995 | James et al. | 342/159 |
| 5,546,085 | 8/1996 | Garnaat et al. | 342/25 |
| 5,581,237 | 12/1996 | DiPoala | 340/552 X |
| 5,687,735 | 11/1997 | Forbes et al. | 128/696 |
| 5,764,142 | 6/1998 | Anderson et al. | 340/556 X |

*Primary Examiner*—Thomas Mullen

*Attorney, Agent, or Firm*—Burns, Doane, Swecker & Mathis LLP

[57] ABSTRACT

A motion sensor has a parasitic response to at least one of radio frequency (RF) or electromagnetic (EM) impulse signals. The motion detection circuit for security systems has a dummy RF receiver for generating an RP response signal, the receiver having a response to at least one of radio frequency (RF) or electromagnetic (EM) impulse signals similar to the parasitic response. An alarm output signal is generated in response to intruder motion in the predetermined area while preventing false alarms due to the parasitic response.

17 Claims, 1 Drawing Sheet

MOTION DETECTION WITH RFI/EMI PROTECTION

FIELD OF THE INVENTION

The present invention relates to a method of motion detection and a motion detection circuit, such as a passive infrared motion detector circuit or an active microwave motion detection circuit. More particularly, the invention relates to a motion detection circuit having means for preventing a false alarm when the sensor and the circuit is subjected to external interference such as radio frequency (RF) noise or impulse (RFI) or an electromagnetic impulse (EMI).

BACKGROUND OF THE INVENTION

Electromagnetic and radio frequency impulses can cause disturbances in any electronic equipment. Motion detection circuits used in security systems are sensitive circuits which must respond to weak motion detection sensor signals. RF and EM impulses are able to generate sufficient parasitic responses in motion detection sensors and in their associated motion detection circuits to result in false alarm signals. In the security industry, false alarms are expensive and very undesirable. Each false alarm must be investigated with the same diligence as true alarms. Many false alarms over time degrade confidence in the security system. Most security agencies or city and municipal police forces will charge per inspection fees for investigating false alarms, especially when the security system generates frequent false alarms.

RFI and EMI may result from a variety of sources, such as lightning, radio transmitters and electrical equipment. In motion detectors, shielding the effects of RFI/EMI is conventionally done by providing metal shielding around the detector and its associated circuitry, by designing the printed circuit board carefully to minimize the circuit's susceptibility to RF, by providing short distance wiring for all low level signals, and by using heavy filtering. Shielding is costly and of limited use. While circuit design in the detector can reduce sensitivity to RFI/EMI, both by reducing the amount of parasitic signal received and by reducing sensitivity to "spike" signals, no conventional detector having a good sensitivity to intruder motion is 100% immune from false alarm generation when RFI/EMI noise is added to other acceptable background noise. Consequently, prior art motion detectors, such as passive infrared, active microwave, dual infrared/microwave and ultrasound motion detectors, suffer from the possibility of false alarm generation when subjected to RFI/EMI.

SUMMARY OF THE INVENTION

It is an object of the present invention to provide a motion detector which compensates for the influence of parasitic RFI/EMI signals and accordingly prevents false alarms due to RFI/EMI.

It is another object of the present invention to provide a motion detector having, for each active channel, an additional dummy channel not active for motion detection yet having a similar RFI/EMI response as the active channel or channels. Designing two similar channels on a printed circuit board is no more difficult than designing one channel, and thus no trial and error is required to ensure that the dummy channel and the active channel will have the same RFI/EMI response in a production model.

The compensation may comprise either suppression of alarm signal generation when RF activity is high, subtraction of RF noise detected from the motion sensor signal, or changing of the alarm signal generation criteria so as to reduce sensitivity when RP noise is detected.

According to the invention, there is provided a motion detection circuit for use with a motion sensor responsive to motion or presence of an intruder in a predetermined area and producing an output signal, the motion sensor having a parasitic response to at least one of radio frequency (RF) and electromagnetic (EM) impulse signals, the circuit comprising: a dummy RF receiver for generating an RF response signal, the receiver having a response to at least one of radio frequency (RF) or electromagnetic (EM) impulse signals substantially identical to or similar to the parasitic response; and means responsive to the dummy RF response signal and the motion sensor output signal for generating an alarm output signal in response to intruder motion in the predetermined area while preventing false alarms due to the parasitic response.

According to the invention, there is also provided a method for preventing an RFI/EMI induced false alarm in a motion detector including a motion sensor having a parasitic RFI/EMI response, comprising the steps of:

obtaining an output signal from the motion sensor;

providing a dummy receiver having a response only to RFI/EMI signals substantially identical to the parasitic RFI/EMI response of the motion sensor;

obtaining an RF response signal from the dummy receiver; and subtracting the RF response signal from the motion sensor output signal.

The invention further provides a method for preventing an RFI/EMI induced false alarm in a motion detector including a motion sensor having a parasitic RFI/EMI response, comprising steps of:

obtaining an output signal from the motion sensor;

providing a dummy receiver having a response only to RFI/EMI signals;

obtaining an RF response signal from the dummy receiver; and suppressing the generation of an alarm signal when the RF response signal exceeds a predetermined threshold.

Preferably, the motion detector circuit according to the invention comprises an active motion sensor channel including a motion sensor and signal analyzer for producing an active alarm signal output and a dummy channel including a dummy RF receiver for generating an RF response signal and including a signal analyzer similar to the signal analyzer of the active channel for producing a dummy alarm signal output. When the dummy channel produces an alarm signal output, the active alarm signal is suppressed. This preferred arrangement allows the net effect of parasitic RF influences on the sensor and the motion detection signal processing circuitry to be taken into account for suppressing an alarm signal created by RF effects alone.

BRIEF DESCRIPTION OF THE DRAWINGS

The invention will be better understood by way of the following description of a preferred embodiment of the invention with reference to the appended drawing, in which.

DETAILED DESCRIPTION OF THE PREFERRED EMBODIMENT

Figure 1:
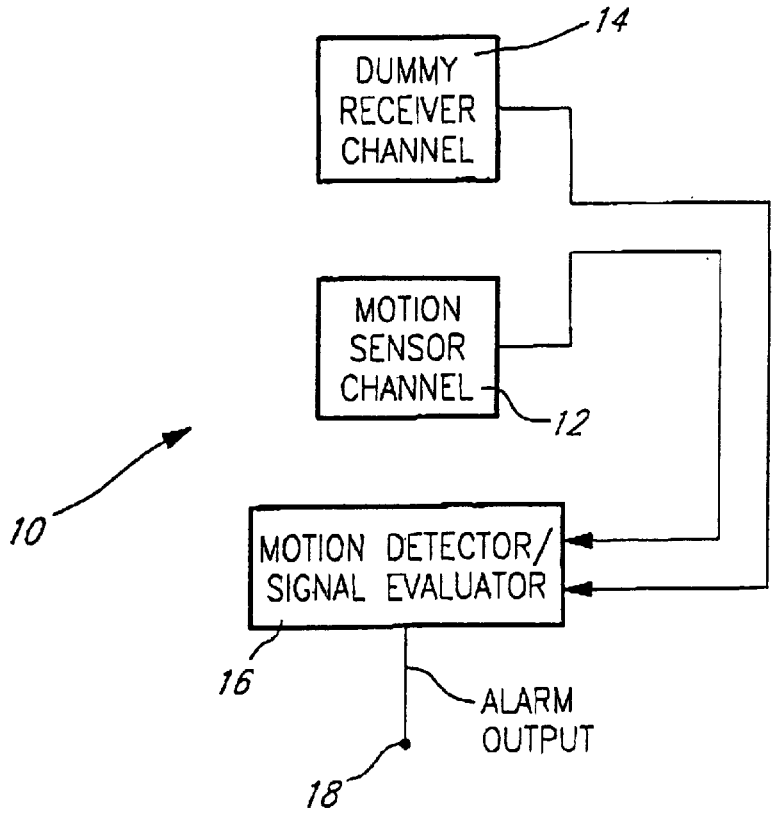
FIG. 1 is a high level block diagram of the motion detector circuit according to the preferred embodiment.

As shown in FIG. 1, the motion detection circuit 10 has a motion sensor channel 12 and a dummy receiver channel 14 both connected to a motion detection or signal evaluation circuit 16. The detection evaluation circuit 16 has an alarm output 18.

The dummy receiver channel 14 in the preferred embodiment is a copy of the circuit layout for the active channel 12, and it has an RF load with a response similar to the RFI/EMI response of sensor 12. The motion sensor channel 12 in the preferred embodiment has a passive infrared sensor which receives infrared radiation through a lens as is known in the art. Reference may be had to U.S. Pat. No. 5,077,549 to Hershkovitz et al. co-invented by the present Applicant, the specification of which is hereby incorporated by reference. Evaluator 16 is connected to both the dummy receiver channel 14 and the sensor channel 12 by conductors that themselves have a similar parasitic RF response, as is shown in FIG. 1. Thus, the printed circuit board layout is entirely similar for both channels 12 and 14. The dummy receiver 14 and the active motion sensor channel 12 have the same signal filtering and amplification components.

Figure 2:
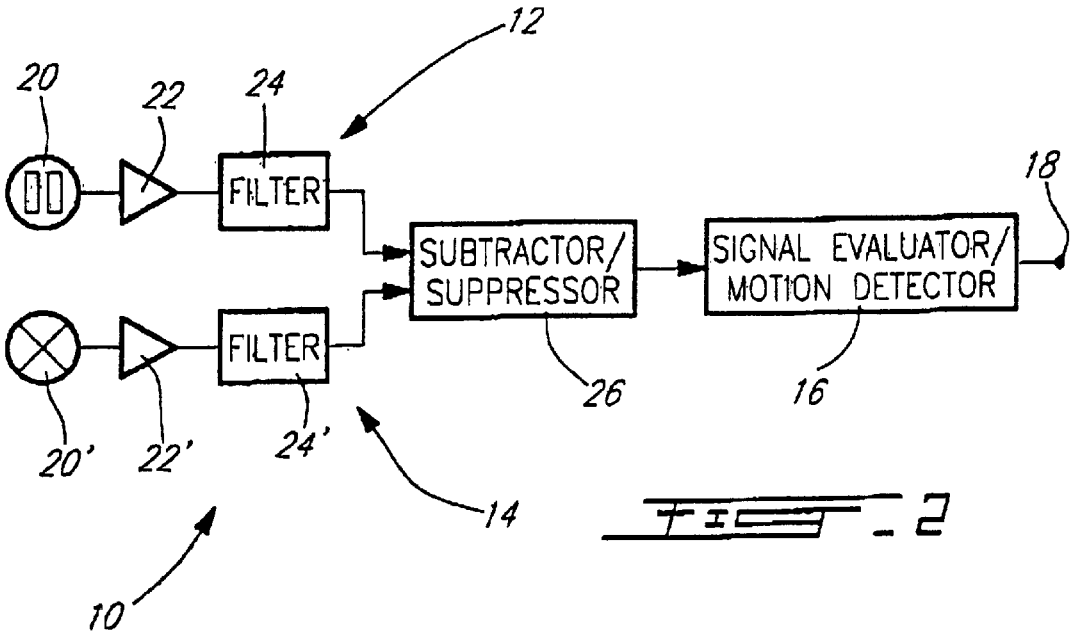
FIG. 2 is a schematic block diagram of the motion detector circuit according to the preferred embodiment.

As shown in FIG. 2, the active channel 12 has a passive infrared motion detector 20, an amplifier 22 and a filter 24. Elements 22 and 24 combine to form signal amplification circuitry, and this circuitry is common to both the active channel 12 and the dummy channel 14, with the same PCB layout being observed as best as possible. The suppressor/subtractor 26 blocks the parasitic RF signal from sensor 20 from reaching the motion detector circuit 16 either by blocking when the signal from filter 24' is above a threshold or by subtracting the signal from filter 24' from the signal from filter 24.

According to the present invention, the evaluator 16 (see FIG. 1) may use the signal from the dummy channel 14 in three ways. First, the dummy channel signal may be subtracted from the motion sensor channel signal to obtain an RFI/EMI free signal. Secondly, the presence of RFI/EMI, above a predetermined threshold and within the frequency range of interest to the evaluator 16 when detecting motion, can be used to block the generation of an alarm signal. To prevent such blocking as a means to disable fraudulently the motion detector using an RF generator, repeated RFI/EMI signals could be detected by evaluator 16 to generate an alarm or trouble signal. Thirdly, the dummy channel output may be used to reduce the sensitivity of the motion detector 16. The sensitivity may be variable, and the level of RF noise preferably lowers the sensitivity as a function of the level of RF noise.

Evaluator 16 may detect whether the RF response of the dummy receiver 14 is above a predetermined threshold. As will be appreciated, the RF response signal may be a positive or negative spike signal, and the absolute value of the signal is detected. This may be done by comparing the RF response to both a positive and a negative threshold. If the threshold is surpassed, the alarm output signal is blocked. If the output signal of the dummy load 14 surpasses the threshold for an extended period (non-impulse) or very frequently, a trouble signal may be output by the evaluator 16 to warn of malfunction or tampering. The dummy sensor 20' of the dummy receiver 14 can be made of inexpensive, passive circuit components provided on the same circuit board as the detection circuit 10, as will be apparent to those skilled in the art.

In an alternative embodiment, the dummy receiver is a masked sensor 20' identical to the sensor 20. Preferably, non-sensitive, reject components from the sensor manufacturer may be used, if such rejects have the same RF response. By providing a physically similar device having a very similar RF response, the evaluator 16 may subtract the RF response signal from the dummy receiver 14 from the motion sensor signal 12 to obtain the desired, RF noise-free motion detection signal. Preferably, such subtraction is carried out in the digital domain, having converted the analog signal from sensor 12 and load 14 to digital.

As will be appreciated, there is an advantage in using identical channels for the active sensor 12 and the dummy channel 14. However, in the embodiment in which the alarm signal is blocked, the dummy channel 14 need not have the exact same response, and consequently it is not necessary to use a copy of the circuit board layout to mimic the same RFI/EMI response. The use of a band pass filter in the dummy receiver is desirable because RF noise outside the frequency range of interest does not matter, but a filter in the dummy channel is not essential.

Although the invention has been described above with reference to a preferred embodiment and an alternate embodiments, it is to be understood that the above description is intended merely to illustrate the invention and not to limit the scope of the invention as defined in the appended claims.

What is claimed is:

1. A motion detection circuit for use with a motion detector responsive to motion or presence of an intruder in a predetermined area and producing an active output signal, the motion detector having a parasitic response to at least one of radio frequency (RF) and electromagnetic (EM) impulse signals, the circuit comprising;

a dummy RF receiver channel generating an RF response signal and having a response to said at least one of radio frequency (RF) and electromagnetic (EM) impulse signals; and means responsive to said RF response signal and said active output signal for generating an alarm output signal in response to intruder motion in said area while preventing false alarms due to said parasitic response.

2. The motion detection circuit as claimed in claim 1, wherein said means responsive to said RF response signal and said active output signal prevents said alarm output signal from being generated when said RF response signal is above a predetermined threshold.

3. The motion detection circuit as claimed in claim 2, wherein said dummy receiver comprises a passive RF load in place of a motion sensor, and amplifier means responsive to said impulse signals in substantially a same manner as an amplifier means of said motion detector is responsive to said impulse signals.

4. The motion detection circuit as claimed in claim 2, wherein said dummy receiver comprises a masked motion sensor, and amplifier means responsive to said impulse signals in substantially a same manner as an amplifier means of said motion detector is responsive to said impulse signals.

5. The motif detection circuit as claimed in claim 1, wherein said means responsive to said RF response signal and said active output signal subtracts said RF response signal from said active output signal, said dummy channel having an RF response substantially identical to said motion detector, whereby said active output signal may still result in an alarm signal generation if motion and RF noise are simultaneous.

6. The motion detection circuit as claimed in claim 5, wherein said dummy receiver comprises a passive RF load in place of a motion sensor, and amplifier means responsive to said impulse signals in substantially a same manner as an amplifier means of said motion detector is responsive to said impulse signals.

7. The motion detection circuit as claimed in claim 6, wherein low level signal processing circuitry of said motion detector and said dummy receiver are both provided on a printed circuit board with substantially a same circuit layout.

8. The motion detection circuit as claimed in claim 5, wherein said dummy receiver comprises a masked motion sensor and amplifier means responsive to said impulse signals in substantially a same manner as an amplifier means of said motion detector is responsive to said impulse signals.

9. The motion detection circuit as claimed in claim 8, wherein signal analyzing circuitry of said motion detector and said dummy receiver are both provided on a printed circuit board with substantially a same circuit layout.

10. The motion detection circuit as claimed in claim 5, wherein low level signal processing circuitry of said motion detector and said dummy receiver are both provided on a printed circuit board with substantially a same circuit layout.

11. A method for preventing an RFI/EMI induced false alarm in a motion detector including a motion sensor channel having a parasitic RFI/EMI response, the method comprising steps of:

obtaining an output signal from the motion sensor;

providing a dummy receiver channel having a response only to RFI/EMI signals substantially identical to the parasitic RFI/EMI response of the motion sensor channel;

obtaining an RF response signal from the dummy receiver channel; and subtracting the RF response signal from the motion sensor output signal.

12. The method as claimed in claim 11, wherein said dummy receiver includes signal amplification circuitry for producing a dummy output signal, said signal amplification circuitry responding to said RFI/EMI signals in a substantially identical manner as signal amplification circuitry of said motion detector responds to said RFI/EMI signals.

13. A method for preventing an RFI/EMI induced false alarm in a motion detector including a motion sensor having a parasitic RFI/EMI response, the method comprising steps of:

obtaining an output signal from the motion sensor;

providing a dummy receiver having a response only to RFI/EMI signals;

obtaining an RF response signal from the dummy receiver; and suppressing a generation of an alarm signal when the RF response signal exceeds a predetermined threshold.

14. The method as claimed in claim 13, wherein said dummy receiver includes signal amplification circuitry for producing a dummy output signal, said signal amplification circuitry responding to said RFI/EMI signals in a substantially same manner as signal amplification circuitry of said motion detector responds to said RFI/EMI signals, said motion detector generating an active output signal, said step of suppressing comprising suppressing said active output signal when said dummy alarm output signal indicates an RF response generated alarm.

15. A method for preventing an RFI/EMI induced false alarm in a motion detector including a motion sensor having a parasitic RFI/EMI response and signal analyzing means for generating an alarm signal, said analyzing means having an adjustable sensitivity, the method comprising steps of:

obtaining an output signal from the motion sensor;

providing a dummy receiver having a response only to RFI/EMI signals;

obtaining an RF response signal from the dummy receiver; and lowering said sensitivity of said signal analyzing means when said RF response signal exceeds a predetermined threshold.

16. The method as claimed in claim 15, wherein said dummy receiver includes signal amplification circuitry for producing a dummy output signal, said signal amplification circuitry responding to said RFI/EMI signals in a substantially same manner as signal amplification circuitry of said motion detector responds to said RFI/EMI signals.

17. The method as claimed in claim 16, wherein said step of lowering comprises lowering said sensitivity of said signal analyzing means by a variable amount in proportion to said RF response signal.

* * * * *